US009975039B1

(12) United States Patent
Semling et al.

(10) Patent No.: US 9,975,039 B1
(45) Date of Patent: May 22, 2018

(54) BUILDING BRICK TOWER TOPPLING GAME

(71) Applicants: Sonja Semling, Fountain City, WI (US); Erik Semling, Fountain City, WI (US)

(72) Inventors: Sonja Semling, Fountain City, WI (US); Erik Semling, Fountain City, WI (US)

( * ) Notice: Subject to any disclaimer, the term of this patent is extended or adjusted under 35 U.S.C. 154(b) by 0 days. days.

(21) Appl. No.: 15/453,371

(22) Filed: Mar. 8, 2017

(51) Int. Cl.

| | |
|---|---|
| ***A63H 33/04*** | (2006.01) |
| ***A63F 9/00*** | (2006.01) |
| ***A63F 9/26*** | (2006.01) |
| *A63F 11/00* | (2006.01) |

(52) U.S. Cl.
CPC ..... *A63F 9/26* (2013.01); *A63F 9/00* (2013.01); *A63F 9/0076* (2013.01); *A63F 2011/0032* (2013.01); *A63F 2250/50* (2013.01)

(58) Field of Classification Search
CPC ..... A63H 33/00; A63H 33/02; A63H 33/04; A63H 33/08; A63F 9/00; A63F 9/08
USPC ..... 446/85, 117, 120–121, 124–128; 273/156, 160, 447, 450
See application file for complete search history.

(56) References Cited

U.S. PATENT DOCUMENTS

| | | | | |
|---|---|---|---|---|
| 3,899,169 A * | 8/1975 | Rhodes | A63F 9/0073 273/450 |
| 4,834,687 A * | 5/1989 | Elam | A63H 33/00 273/DIG. 30 |
| 5,611,544 A * | 3/1997 | Grebler | A63F 9/0073 273/447 |
| 6,029,974 A * | 2/2000 | Povitz | A63F 9/1208 273/156 |
| 6,964,593 B1 * | 11/2005 | Stevens | A63H 33/3072 434/393 |

* cited by examiner

*Primary Examiner* — Kien Nguyen

(57) ABSTRACT

A building brick tower toppling game includes a plurality of base plates each having a top side comprising a plurality of male engagement members and a bottom side comprising a plurality of female engagement members. Mounting bricks each have a top end and a bottom end. The top ends comprise a plurality of male engagement members and the bottom ends comprise a female engagement member. Each of the male engagement members of the mounting bricks is releasably engageable with the female engagement members of the base plates and others of the mounting bricks. The female engagement member of the mounting bricks is releasably engageable with the male engagement members of the base plates and others of the mounting bricks. The mounting bricks are coupled together to define pillars. A striking implement is used for striking the pillars to break the pillars where attached ones of the mounting bricks are joined.

8 Claims, 4 Drawing Sheets

BUILDING BRICK TOWER TOPPLING GAME

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tower collapsing games and more particularly pertains to a new tower collapsing game for allowing players to selectively break portions of a tower while attempting to retain the tower in an erect condition.

BRIEF SUMMARY OF THE INVENTION

An embodiment of the disclosure meets the needs presented above by generally comprising a plurality of base plates. Each of the base plates has a top side comprising a plurality of male engagement members and a bottom side comprising a plurality of female engagement members. Each of plurality of mounting bricks has a top end, a bottom end and a peripheral surface extending between the top and bottom ends. The top ends of each of the mounting bricks comprise a plurality of male engagement members and each of the bottom ends comprises a female engagement member. Each of the male engagement members of the mounting bricks is frictionally and releasably engageable with the female engagement members of the base plates and other ones of the mounting bricks. The female engagement member of the mounting bricks is frictionally and releasably engageable with the male engagement members of the base plates and other ones of the mounting bricks. The mounting bricks are coupled together to define a plurality of pillars. A striking implement is used for striking the pillars to break the pillars where attached ones of the mounting bricks are joined.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
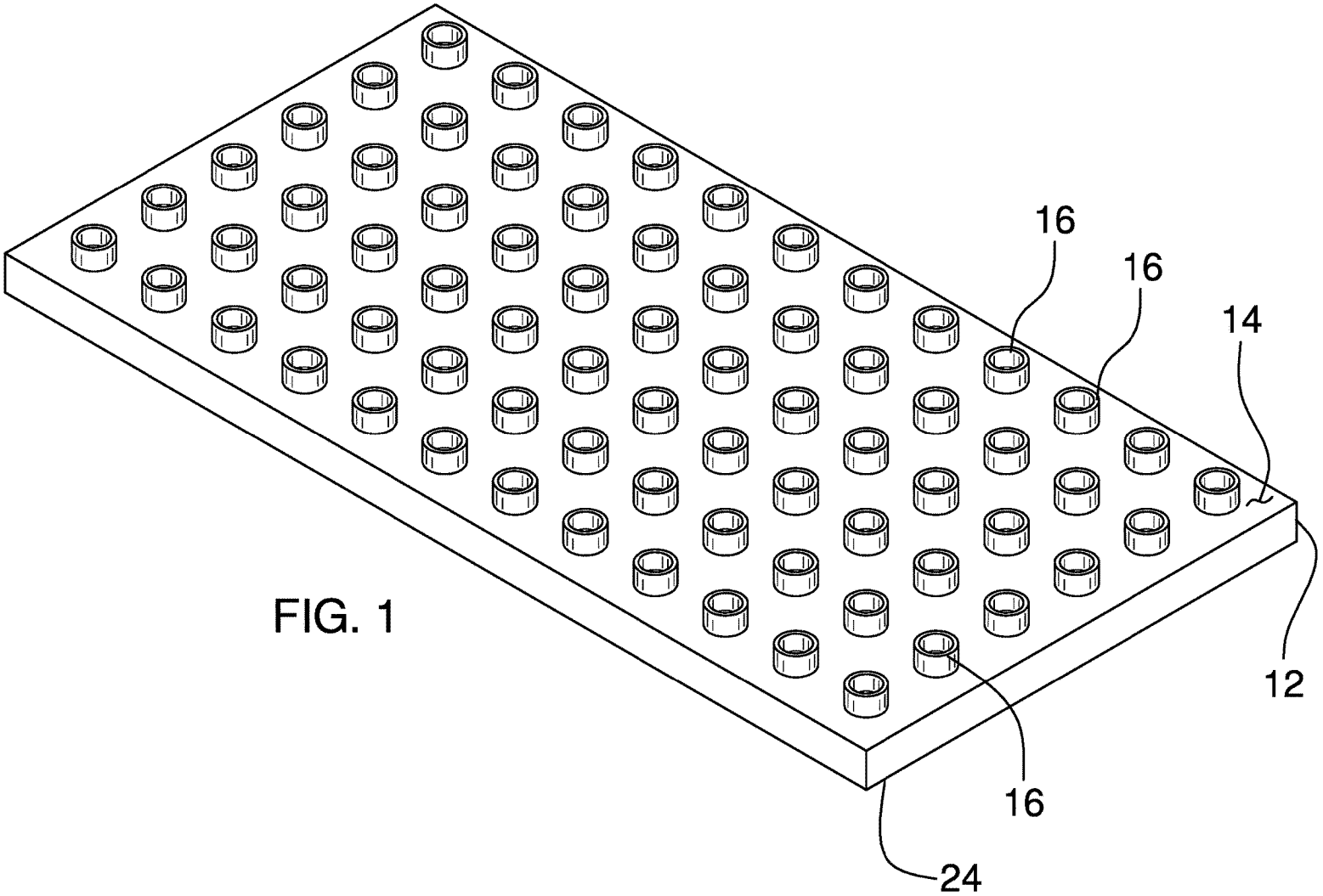
FIG. 1 is a top perspective view of a base plate of a building brick tower toppling game according to an embodiment of the disclosure.
Figure 4:
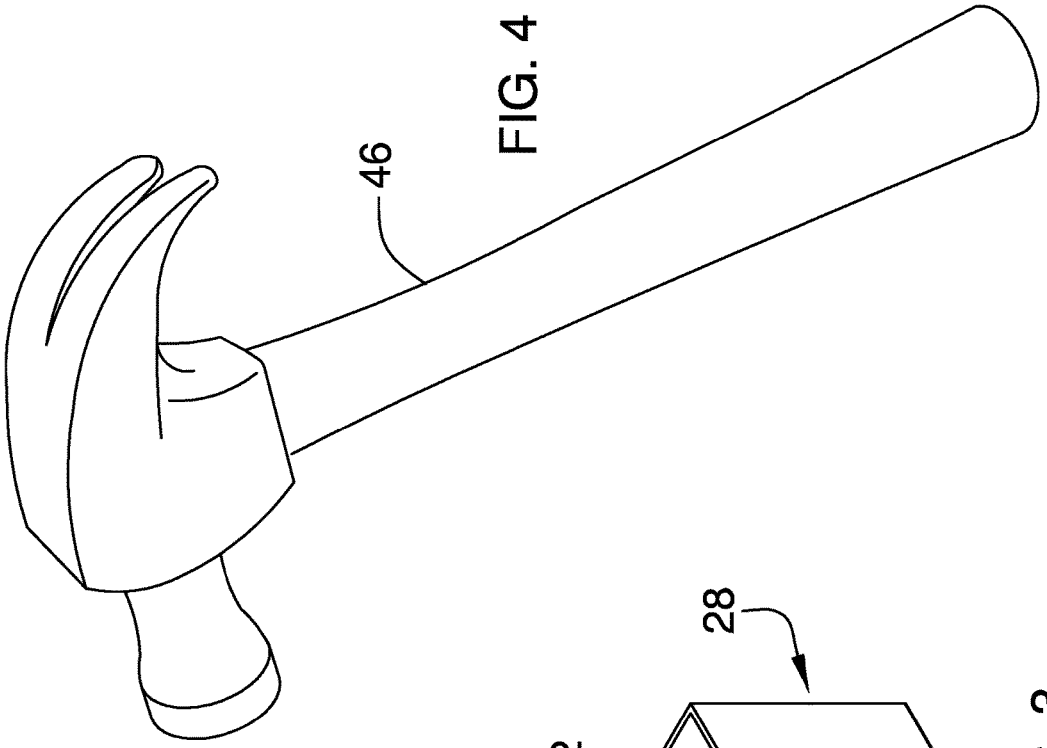
FIG. 4 is a perspective view a striking implement of an embodiment of the disclosure.
Figure 3:
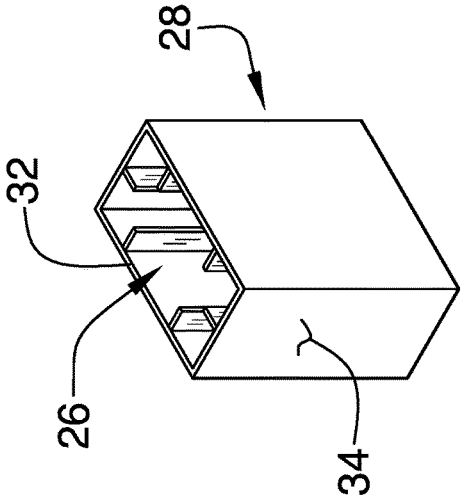
FIG. 3 is a bottom perspective view mounting brick of an embodiment of the disclosure.
Figure 2:
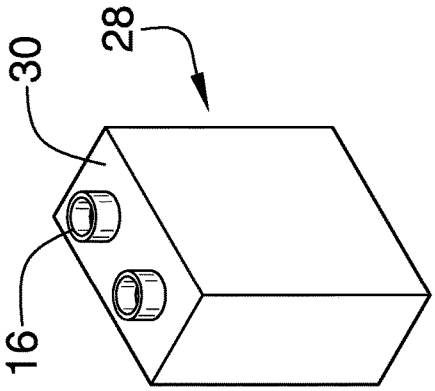
FIG. 2 is a top perspective view of a mounting brick of an embodiment of the disclosure.

With reference now to the drawings, and in particular to FIGS. 1 through 6 thereof, a new tower collapsing game embodying the principles and concepts of an embodiment of the disclosure and generally designated by the reference numeral 10 will be described.

Figure 5:
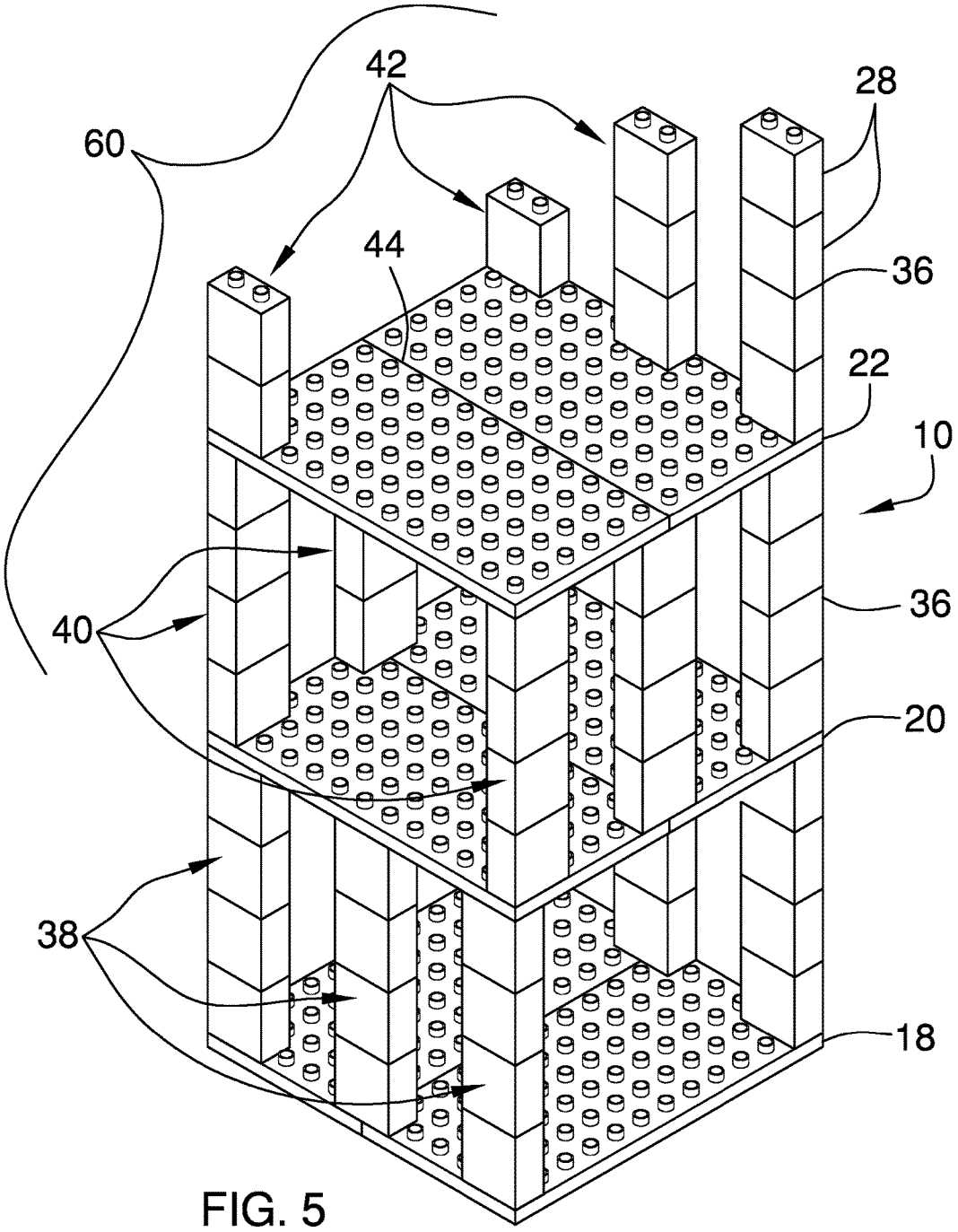
FIG. 5 is a perspective top view of an embodiment of the disclosure.
Figure 6:
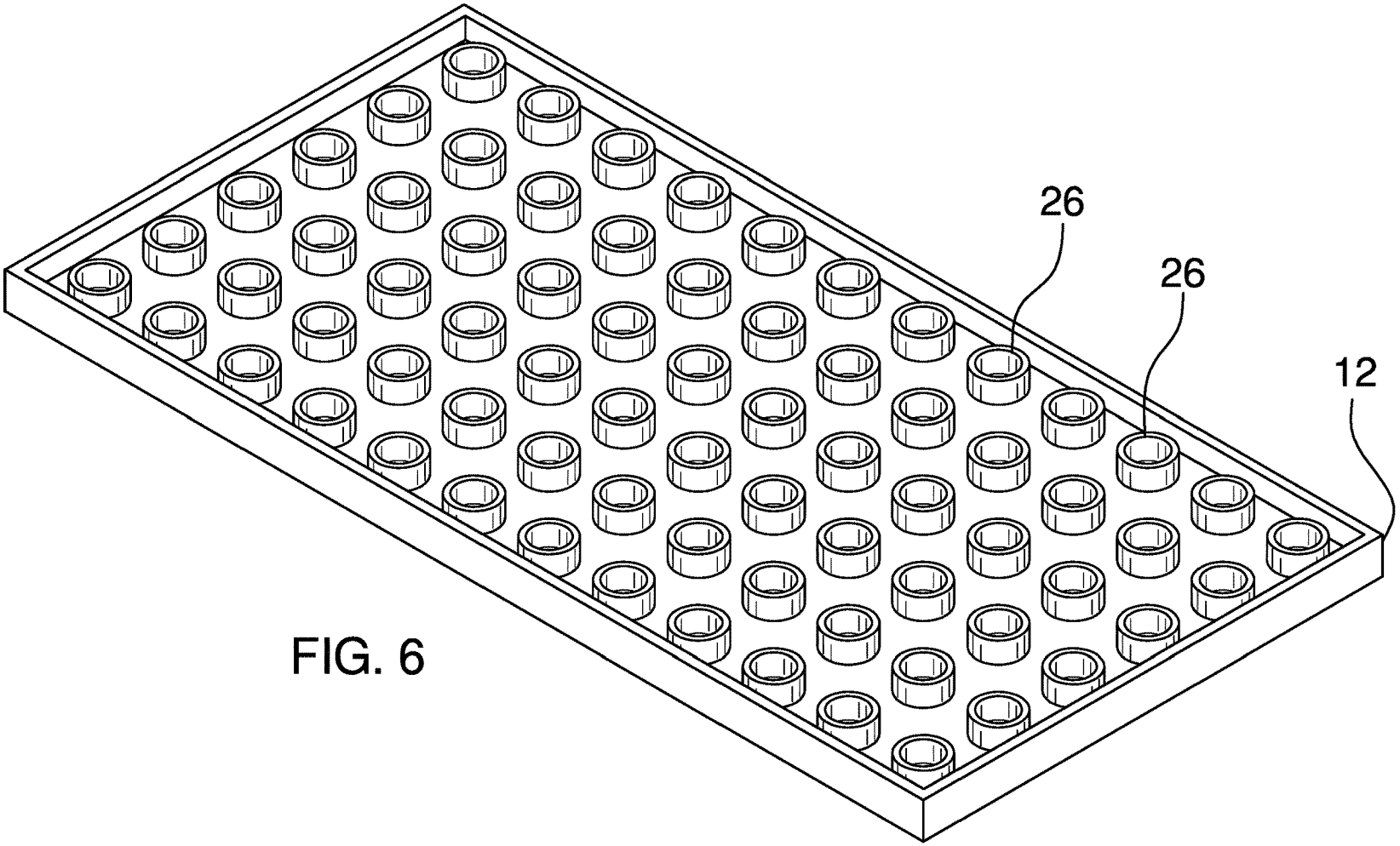
FIG. 6 is a bottom perspective view of the base plate of an embodiment of the disclosure.

As best illustrated in FIGS. 1 through 6, the building brick tower toppling game 10 generally comprises providing a plurality of base plates 12. Each of the base plates 12 has a top side 14 comprising a plurality of male engagement members 16. The base plates 12 include at least a first base plate 18, a second base plate 20 and a third base plate 22. Each of the base plates 12 has a bottom side 24 comprising a plurality of female engagement members 26. The base plates 12 each have a length and width greater than 3.0 inches. As can be seen in FIG. 5, the base plates 12 may each have a rectangular shape such that when they are placed next to each other a pair of base plates 12 forms a square or a larger rectangle. In such a configuration, the term first base plate 18, second base plate 20, etc. will be defined to include a pair of base plates positioned coplanar with respect to each other as well as single base plates 12 should they be used in that fashion. While only three base plates 18, 20, 22 are discussed herein, it should be understood that there is no limit to the number of base plates 12 that are used though it would be practical to usually have twelve or less as each will form a level in a vertical structure as detailed below.

A plurality of mounting bricks 28 is provided. Each of the mounting bricks 28 has a top end 30, a bottom end 32 and a peripheral surface 34 extending between the top 30 and bottom 32 ends. The top ends 30 of each of the mounting bricks 28 comprise a plurality of male engagement members 16 and each of the bottom ends 32 comprises a female engagement member 26 or a plurality of female engagement members 26. Each of the male engagement members 16 of the mounting bricks 28 is frictionally and releasably engageable with the female engagement members 26 of the base plates 12 and other ones of the mounting bricks 28. The female engagement member 26 of the mounting bricks 28 is frictionally and releasably engageable with the male engagement members 16 of the base plates 12 and other ones of the mounting bricks 28. The male 16 and female 26 engagement members may have any conventional, frictional securing means such that they mate with each other. Brick systems utilizing similar structures for frictionally coupling together toy bricks are ubiquitous in the toy arts and are found in multiple references such as U.S. Pat. No. 3,005,282 and are sold under the tradenames Lego and Duplo. In the present embodiment, each of the mounting bricks 28 has a length and width each being less than 2.5 inches. More particularly, the mounting bricks 28 may each have a height greater than its width. The mounting bricks 28 shown have a generally rectangular cross-section taken perpendicular to a line extending through the top 30 and bottom 32 ends. However the mounting bricks may have any geometric cross-section including cylindrical, hexagonal, pentagonal, triangular and the like.

During game play, a plurality of pillars 36 are created with the mounting bricks 28 by coupling together two or more of the mounting bricks 28 such that at least a first set of pillars 38, a second set of pillars 40 and a third set of pillars 42 is defined. Each pillar 36 may contain far greater than two mounting bricks 28 and as can be seen in FIG. 5, an embodiment shows four mounting bricks 28 being positioned in each pillar 36 and typically each pillar 36 will have 6 or less mounting bricks. Regardless of the number of mounting bricks 28 in each pillar, each of the pillars 36 in each set has a same height. Also, the pillars 36 of one set may have a different height than the pillars 36 in a different one of the sets.

During the setting up of the game 10, the first set of pillars 38 are mounted to the male engagement members 16 on the first base plate 18. As can be seen in FIG. 5, the first base plate 18 may be comprised of a pair of base plates 12 and this same configuration may utilized for additional levels. The purpose of this type of structure will be explained below. The bottom mounting brick 28 of one or more pillars 36 may span a break 44 being the base plates 12 to secure them together. The second base plate 20 is then mounted on top of the first set of pillars 38. The second set of pillars 40 are then mounted to the male engagement members 16 on the second base plate 20 and the third base plate 22 is mounted on top of the second set of pillars 40, wherein the pillars 38 and the base plates 12 form levels that overall define a tower 60. This stacking may be repeated to create as many levels as the players determine but the number of levels will typically be twelve or less.

A striking implement 46 is provided which is used for striking the pillars 36 of the tower 60. The striking implement 46 may resemble a hammer though other shapes including miniature bats, rods, swords or the like may be utilized. The striking element 46 may be comprised of any conventional material, however it may be beneficial to construct the striking element 46 out of a material that is no harder than the material used to form the mounting bricks 28 to inhibit damage to the mounting bricks 28. Thus, the striking implement 46 may be comprised of a plastic material. Alternatively, the striking implement 46 may be comprised of a material having greater compression than the material of the mounting bricks 28 and therefore may be comprised of an elastomeric material, for example, which is resiliently compressible.

For the game, the players build the tower 60 as described above. Each level will include at least three pillars 36 though more pillars 38, such as least four and more preferably six or as many as eight pillars 38 may be used. The pillars 38 may themselves be constructed using as many mounting bricks 28 as desired though it should be understood that the greater the number of mounting bricks 28 used, the easier it will be to break the pillars 36 during the game. Once the tower 60 has been constructed, each of the players of the game 10 will begin to take turns hitting one of the pillars 36 with the striking implement 46. The object is to strike and break a pillar 36; that is cause the pillar 36 to come apart where two mounting bricks 28 are joined together, without causing the overall collapse of the tower 60. The player will continue to strike one or more of the pillars 36 until a pillar 36 breaks. If the tower 60 does not topple after the pillar 36 is broken, the next player attempts to break a pillar 36 and so on. At some point, when the tower 60 is structurally weakened enough, one player will break a pillar 36 which in turn will cause one or more of the base plates 12 to fall from a remaining portion of the tower 60 or cause the entire tower 60 to fall over due to its center of gravity moving outside of the first base plate 18. Using two base plates 12 in a coplanar relationship will make the tower 60 more unstable and thus add challenge to the game play. When the tower completely 60 or partially collapses, that player who caused the tower 60 to essentially fall down the game is over and the last person to successfully knock out one or more bricks 28 while retaining the rest of the tower intact wins the game.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A method of playing a building brick game comprising the steps of:

providing a plurality of base plates, each of said base plates having a top side comprising a plurality of male engagement members, said base plates including at least a first base plate, a second base plate and a third base plate, each of said plates having a bottom side comprising a plurality of female engagement members;

providing a plurality of mounting bricks, each of said mounting bricks having a top end, a bottom end and a peripheral surface extending between said top and bottom ends, said top ends of each of said mounting bricks comprising a plurality of male engagement members and each of said bottom ends comprising a female engagement member, each of said male engagement members of said mounting bricks being frictionally and releasably engageable with said female engagement members of said base plates and other ones of said mounting bricks, said female engagement member of said mounting bricks being frictionally and releasably engageable with said male engagement members of said base plates and other ones of said mounting bricks;

creating a plurality of pillars with said mounting bricks by coupling together two or more of said mounting bricks such that at least a first set of pillars, a second set of pillars and a third set of pillars is defined, each of said pillars being vertically orientated, each of said pillars in each said set having a same height, each of said first, second and third sets of pillars including at least three of said pillars;

mounting said first set of pillars to said male engagement members on said first base plate, each of said pillars of said first set of pillars being spaced from each other;

mounting said second base plate on top of said first set of pillars;

mounting said second set of pillars to said male engagement members on said second base plate, each of said pillars of said second set of pillars being spaced from each other;

mounting said third base plate on top of said second set of pillars;

mounting said second set of pillars to said male engagement members on said third base plate, wherein said pillars and said base plates define a tower, each of said pillars of said third set of pillars being spaced from each other;

providing a striking implement;

taking turns hitting one of said pillars with said striking implement; and loosing when any portion of said tower including one of said base plates falls away from a remaining portion of said tower.

2. A building brick game for building and knocking down a structure, said game comprising:

a plurality of base plates, each of said base plates having a top side comprising a plurality of male engagement members and a bottom side comprising a plurality of female engagement members;

a plurality of mounting bricks, each of said mounting bricks having a top end, a bottom end and a peripheral surface extending between said top and bottom ends, said top ends of each of said mounting bricks comprising a plurality of male engagement members and each of said bottom ends comprising a female engagement member, each of said male engagement members of said mounting bricks being frictionally and releasably engageable with said female engagement members of said base plates and other ones of said mounting bricks, said female engagement member of said mounting bricks being frictionally and releasably engageable with said male engagement members of said base plates and other ones of said mounting bricks, wherein said mounting bricks are coupled together to define a plurality of pillars, each of said pillars being vertically orientated;

said plurality of pillars including a first set of pillars, a second set of pillar and a third set of pillars, each of said pillars in each said set having a same height, each of said first, second and third sets of pillars including at least three of said pillars;

said first set of pillars being attached to said male engagement members on said first base plate and said female engagement members on said second base plate, each of said pillars of said first set of pillars being spaced from each other;

said second set of pillars being attached to said male engagement members on said second base plate and to said female engagement members on said third base plate, each of said pillars of said second set of pillars being spaced from each other;

said second set of pillars being attached to said male engagement members on said third base plate, each of said pillars of said third set of pillars being spaced from each other; and a striking implement configured for striking said pillars to break said pillars where attached ones of said mounting bricks are joined.

3. The building brick game according to claim 2, wherein each of said base plates has a length and width greater than 4.0 inches.

4. The building brick game according to claim 3, wherein each of said mounting bricks having a length and width each being less than 2.5 inches.

5. The building brick game according to claim 2, wherein said striking plate has a shape of a hammer.

6. The building brick game according to claim 2, wherein said striking implement is comprised of a same material as said mounting bricks.

7. The building brick game according to claim 6, wherein said material is a plastic material.

8. The building brick game according to claim 2, wherein said striking implement is comprised of a material being more compressible than a material forming said mounting bricks.

* * * * *